US009144278B2

(12) United States Patent
Morrow

(10) Patent No.: US 9,144,278 B2
(45) Date of Patent: Sep. 29, 2015

(54) REUSABLE AND DISPOSABLE GROCERY BAGS

(71) Applicant: Jim Neal Morrow, Cedar Park, TX (US)

(72) Inventor: Jim Neal Morrow, Cedar Park, TX (US)

( * ) Notice: Subject to any disclaimer, the term of this patent is extended or adjusted under 35 U.S.C. 154(b) by 0 days.

(21) Appl. No.: 14/219,936

(22) Filed: Mar. 19, 2014

(65) Prior Publication Data

US 2014/0291329 A1 Oct. 2, 2014

Related U.S. Application Data

(60) Provisional application No. 61/805,384, filed on Mar. 26, 2013.

(51) Int. Cl.
*A45C 7/00* (2006.01)
*A45C 3/04* (2006.01)

(52) U.S. Cl.
CPC . *A45C 7/009* (2013.01); *A45C 3/04* (2013.01); *A45C 7/0077* (2013.01)

(58) Field of Classification Search
CPC ..... A45C 3/04; A45C 13/02; A45C 11/20; A45C 3/001; A45C 7/009; A45C 7/0077; B62B 3/1464; B65D 33/001; B65D 31/12
USPC ..... 224/411; 220/495.08, 495.09, 495.1; 383/37; 38/38–40
See application file for complete search history.

(56) References Cited

U.S. PATENT DOCUMENTS 4,235,350 A * 11/1980 Valentino ..... 220/495.1
4,316,353 A 2/1982 Suominen
4,363,405 A 12/1982 Christie
4,560,096 A * 12/1985 Lucas et al. ..... 224/411
4,708,243 A * 11/1987 Nailon ..... 206/315.11
4,850,507 A 7/1989 Lemongelli et al.
4,863,125 A 9/1989 Bateman
4,871,100 A * 10/1989 Posner ..... 224/411
4,966,318 A * 10/1990 Dutka ..... 224/411
5,046,860 A 9/1991 Brennan
5,182,895 A * 2/1993 Lugo ..... 53/469
5,209,385 A * 5/1993 Ledesma ..... 224/681
5,226,576 A * 7/1993 Ellsworth ..... 224/572
5,310,102 A * 5/1994 Hougham ..... 224/585
5,350,045 A * 9/1994 Robertson ..... 190/110
5,465,845 A 11/1995 Norby et al.
5,531,366 A * 7/1996 Strom ..... 224/153
5,660,476 A * 8/1997 DeCoster ..... 383/29
6,626,337 B1 * 9/2003 Cox ..... 224/275
6,971,697 B2 12/2005 Morales
7,422,126 B2 9/2008 Ceschi
7,958,920 B1 * 6/2011 Olsson ..... 150/112
7,992,879 B2 8/2011 Eisenberg et al.
8,177,431 B2 5/2012 Turvey et al.
8,376,200 B2 * 2/2013 Kim ..... 224/563
8,905,411 B1 * 12/2014 Blanton ..... 280/33.992
2004/0001653 A1 * 1/2004 Coval Carr et al. ..... 383/111
2006/0169697 A1 8/2006 Koch
2006/0201979 A1 * 9/2006 Achilles ..... 224/411

(Continued)

*Primary Examiner* — Jes F Pascua
*Assistant Examiner* — Peter Helvey
(74) *Attorney, Agent, or Firm* — Pierson IP, PLLC

(57) ABSTRACT

Embodiments described herein are related to a reusable grocery bag with a set of disposable liners coupled to an inner surface of the reusable grocery bag. Embodiments disclosed herein utilize disposable liners to reduce, limit or eliminate the spread of bacteria and germs while a consumer is shopping for various items. In embodiments, the disposable liner may be comprised of biodegradable materials.

9 Claims, 5 Drawing Sheets

(56) References Cited

U.S. PATENT DOCUMENTS

| | | | | |
|---|---|---|---|---|
| 2006/0266752 | A1* | 11/2006 | Scherer | 220/495.08 |
| 2009/0101253 | A1 | 4/2009 | Kinskey et al. | |
| 2009/0317021 | A1* | 12/2009 | Taylor | 383/6 |
| 2010/0051493 | A1 | 3/2010 | Tracy | |
| 2010/0104223 | A1* | 4/2010 | Hickey et al. | 383/12 |
| 2010/0320246 | A1* | 12/2010 | Taylor | 224/411 |
| 2011/0182532 | A1* | 7/2011 | Baltus | 383/109 |
| 2011/0198376 | A1* | 8/2011 | Oh | 224/411 |
| 2012/0267375 | A1 | 10/2012 | Egan et al. | |
| 2013/0048689 | A1* | 2/2013 | Ling | 224/411 |
| 2014/0140643 | A1* | 5/2014 | Li | 383/111 |

* cited by examiner

REUSABLE AND DISPOSABLE GROCERY BAGS

CROSS-REFERENCE TO RELATED APPLICATIONS

This application claims a benefit of priority under 35 U.S.C. §119 to Provisional Application No. 61/805,384 filed on 26 Mar. 2013, which is fully incorporated herein by reference in its entirety.

TECHNICAL FIELD

This disclosure relates generally to systems and methods for disposable liners coupled to a reusable grocery bag. Specifically, this disclosure relates to a set of biodegradable, disposable liners coupled to an inner sidewall of a reusable grocery bag.

BACKGROUND

Reusable shopping bags are considered an alternative to using single-use, disposable plastic or paper grocery bags when transporting groceries or other items from a retail establishment. Conventionally, reusable shopping bags are comprised of a durable material that may be reused many times.

A reusable bag is considered to be an environmentally friendly alternative to petroleum based plastic bags, which are subsequently placed in landfills harming the environment. Reusable bags may require fewer natural resources and produce fewer emissions of harmful gases than disposable bags because reusable bags may be recycled.

However, during use, a reusable bag may be in contact with bacteria related to sickness. Particularly, reusable grocery bags may be in contact with e-coli or other bacteria that is found in food products.

Accordingly, needs exist for more sanitary and environmentally friendly grocery bags.

SUMMARY

Embodiments described herein are related to a reusable grocery bag with a set of disposable liners coupled to an inner surface of the reusable grocery bag. Embodiments disclosed herein utilize disposable liners to reduce, limit, or eliminate the spread of bacteria and germs while a consumer is shopping for various items.

In embodiments, the set of disposable liners may be coupled to an inner surface of the reusable grocery bag. The disposable liners may be coupled to an inner sidewall of the reusable grocery bag. While coupled to the inner sidewall of the reusable grocery bag, the disposable liners may extend from a top surface of the inner sidewall to a lower surface of the inner sidewall to maximize the size of the disposable liners and efficiently placing the disposable liners within the reusable grocery bag.

In embodiments, one of the disposable liners of the set of disposable liners may be decoupled from the set of disposable liners. The decoupled disposable liner may be secured to an upper portion of the reusable grocery bag or over an upper surface of the reusable grocery bag. By placing the disposable liner over the edges of the reusable grocery bag, the disposable liner may be secured to the reusable grocery bag.

In use a consumer may place items within the disposable liner, covering the inner surface of reusable grocery bag, to transport the items. Subsequently to removing the items from the inner surface of the reusable grocery bag, the disposable liner may be removed from the inner surface of the reusable grocery bag.

In embodiments, the reusable grocery bag may be comprised of a pliant and resilient material fabric, such as a durable synthetic fiber material, mesh polyester, cotton, rubber, etc. In embodiments, the disposable liners may be comprised of a biodegradable material, such as biodegradable plastics, bio plastics, or any other biodegradable fabric.

In embodiments, an upper portion of each of the disposable liners within the set of the disposable liners may have an orifice. The orifice of the disposable liner may be configured to align with orifices within reusable bag to form a unified handle, wherein the unified handle may extend through the disposable liners and the reusable bag.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention. The invention includes all such substitutions, modifications, additions or rearrangements.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore nonlimiting, embodiments illustrated in the drawings, wherein identical reference numerals designate the same components. Note that the features illustrated in the drawings are not necessarily drawn to scale.

Figure 1:
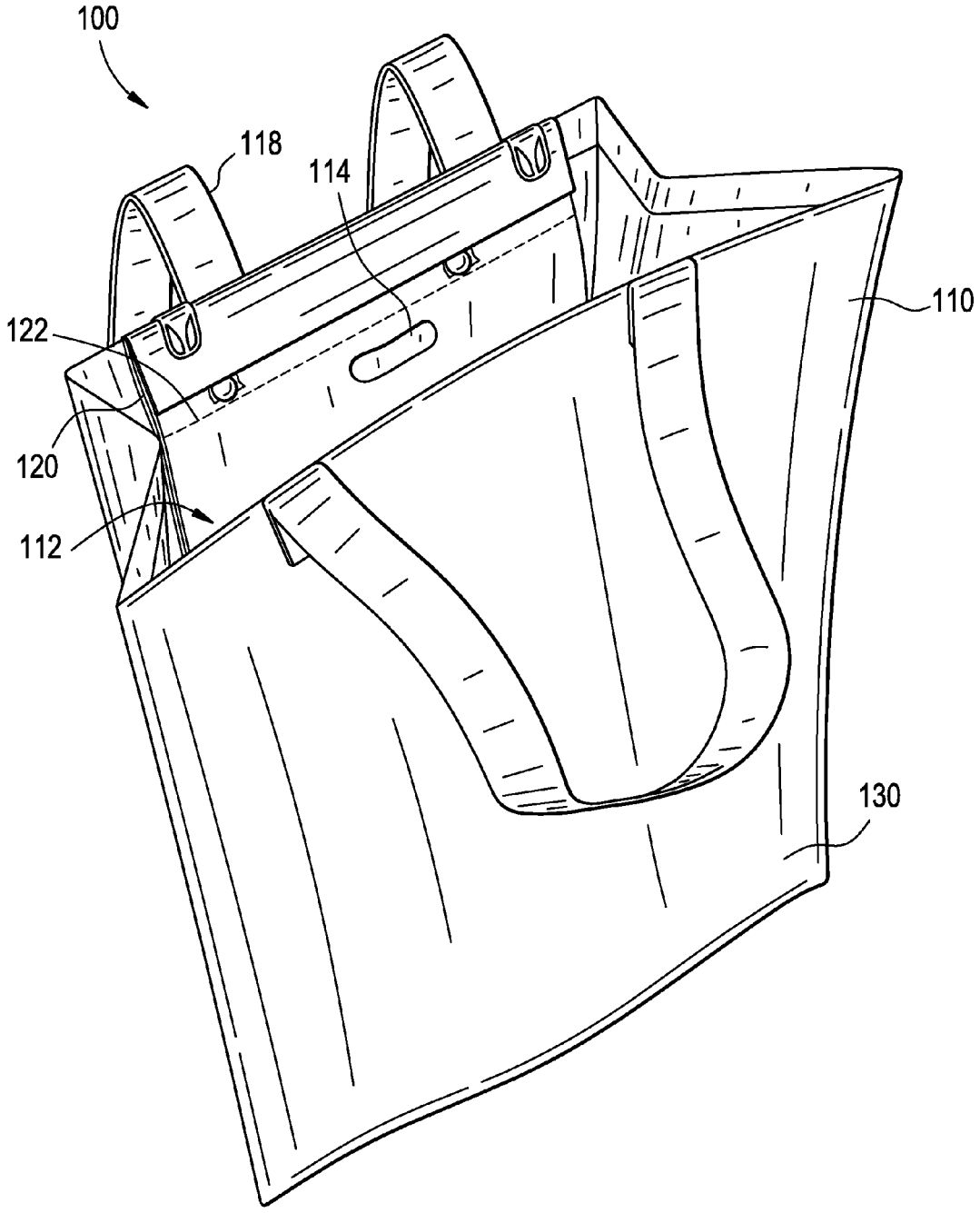
FIG. 1 depicts one embodiment of disposable liners coupled to a reusable grocery bag.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

The invention and the various features and advantageous details thereof are explained more fully with reference to the nonlimiting embodiments that are illustrated in the accompanying drawings and are detailed in the following description.

Descriptions of well-known starting materials, processing techniques, components, and equipment are omitted so as not to unnecessarily obscure the invention in detail.

Embodiments disclosed herein are directed towards a reusable grocery bag with a set of disposable liners coupled to an inner surface of the reusable grocery bag. In embodiments, while in use the disposable liners to cover an inner surface of the reusable grocery bag. After use, the disposable liners may be removed from the inner surface of the reusable grocery bag. Items disposed within the inner surface of the disposable liners may not touch or may not come into contact with the inner surface of the reusable grocery bag. Accordingly, embodiments may reduce, limit or eliminate the spread of bacteria and germs caused by using reusable grocery bags.

FIG. 1 depicts one embodiment of a grocery bag 100. Grocery bag 100 may include a reusable grocery bag 110 and a set of disposable liners 120.

Grocery bag 100 may be configured to be transported from a consumer's home, office, or any other location to a retail store. In embodiments, the consumer may visit the retail store to shop for items such as milk, produce, groceries, and/or other household items. The consumer may traverse the aisles of the retail store and places items they desire to purchase within reusable grocery bag 110, which is lines by a disposable liner 120, and the items may contact disposable liner 120.

Reusable grocery bag 110 may include a main compartment 112, orifices 114, and coupling members 116. For example, reusable grocery bag 110 may be configured to provide sufficient strength to carry products, such as produce or other grocery products within main compartment 112. Reusable grocery bag 110 may be comprised of a pliant, flexible, and resilient material fabric, such as a durable synthetic fiber material, mesh polyester, cotton, rubber, etc. Reusable grocery bag 110 may also be comprised of a material that is washable, such that reusable grocery bag 110 may be washed for reuse. Reusable grocery bag 110 may be a transportable bag configured to carry, transport, and secure items from a first location to a second location within main compartment 112 of reusable grocery bag 110.

Main compartment 112 may be an inner surface of the reusable grocery bag 110. In one embodiment, main compartment 112 may extend from a first sidewall of reusable grocery bag 110 to a second sidewall of reusable grocery bag 110 to increase or maximize the area where items may be placed within main compartment 112. In embodiments where reusable grocery bag 110 is substantially cylindrical in shape, main compartment 112 may extend across a diameter of reusable grocery bag 110. Main compartment 112 may be configured to extend across an inner surface of reusable grocery bag 110. In other embodiments, reusable grocery bag 110 may include secondary, smaller compartments (not shown). The secondary compartments may be disposed on the inner and/or outer surface of reusable grocery bag 110.

Orifices 114 may be openings within grocery bag 110. In one embodiment, orifices 114 may be positioned on the upper surface of the sidewalls of reusable grocery bag 110. Orifices 114 may be configured to be a handle for reusable grocery bag 110 where the consumer may place his hand through orifices 114, traversing reusable grocery bag 110. In other embodiments, reusable grocery bag 110 may have a handles 118 positioned on both sides of the reusable grocery bag 110. Handles 118 may be straps, extending from a first side of reusable grocery bag 110 to the second side of reusable grocery bag 110.

Disposable liners 120 may be a bag configured to be disposed within main compartment 112 of the reusable bag 110 and cover the inner surface of main compartment 112. Disposable liners 120 may comprise a set of the disposable liners 120, and may include separator member 122, orifices 124, and second coupling members 126. Disposable liner 120 may be comprised of biodegradable materials, such as paper, cotton, biodegradable plastics, bio plastics, or any other biodegradable fabric. In embodiments, disposable liner 120 may be comprised of biodegradable materials that may biodegrade at least within one hundred and twenty days. In embodiments, by disposable liners 120 being biodegradable liners, disposable liners 120 may also reducing pollution caused by petroleum based grocery bags. Disposable liners 120 may be configured to cover main compartment 112 to reduce limit or eliminate the spread of bacteria and germs while a consumer is shopping for various items.

The set of disposable liners 120 may be coupled to an inner sidewall of main compartment 112 of the reusable grocery bag 110. The set of disposable liners 120 may be arranged perpendicularly to a bottom surface of main compartment 112, and may be positioned flush against the inner sidewall of main compartment 112 when coupled together. The set of disposable liners 120 may be positioned against the sidewall of main compartment 112 to conserve space within main compartment 112, while also allowing access to the disposable liners 120 via an opening of the top surface of main compartment 112, wherein disposable liners 120 may be accessed even if one of the disposable liners 120 is covering main compartment 112.

Disposable liners 120 may be individually removed from the set of disposable liners 120. In embodiments, one of the disposable liners 120 may be removed from the set of disposable liners 120 along separator member 122. Separator member 122 may be perforations, folds, indentions, cuts, or any other known mechanism configured to decouple one of the disposable liners from the set of disable liners 120. Separator member 122 may be disposed across a width of each of the disposable liners 120. In other embodiments, each of the disposable liners 120 may be coupled together via an adhesive along a top surface of the disposable liners 120 without a separator member 122. If one of the disposable liners 120 is decoupled from of the set of disposable liners 120, the decoupled disposable liner 120 may be secured to an upper surface of reusable grocery bag 110. The decoupled disposable liner 120 may be configured to be cover main compartment 112 of reusable grocery bag 110, such that items disposed within grocery bag 110 may not touch or contact the inner surface of reusable grocery bag 110. Additionally, the decoupled disposable liner 120 may be configured to cover the other disposable liners 120. Subsequently to removing the items from disposable liner 120, and disposable liner 120 may be removed from main compartment 112 of reusable grocery bag 110. In embodiments, there may be a plurality of sets of disposable liners 120, wherein each set may be removeably coupled to a sidewall of the reusable grocery bag 110.

In embodiments, one of the disposable liners 120 may be configured to extend across an upper surface of main compartment 112 without being removed from the set of disposable liners. Accordingly, the disposable liners 120 may be configured to cover main compartment 112 without being removed from the set of disposable liners 120. Subsequently to covering main compartment 112 with disposable liner 120, disposable liner 120 may be decoupled from the set of disposable liners 120.

Orifices 124 may be openings within disposable liners 120. In one embodiment, orifices 124 may be positioned on the upper surface of the sidewalls of disposable liners 120. Orifices 124 may be configured to be a handle for disposable liners 120. In embodiments, orifices 124 may be configured to be similarly sized and shaped and also aligned with orifices 114 on reusable grocery bag 110. Accordingly, the consumer may place his hand through orifices 114 and 124, traversing reusable grocery bag 110 and liners 120. Further, orifice 124 may be configured to transport disposable liners 120 if disposable liners 120 are not positioned within reusable grocery bag 110.

The disposable liners 120 may also be substantially the same height and width as an inner sidewall of main compartment 112 of reusable grocery bag 110. Disposable liners 120 may be configured to be disposed to extend from a lower surface of main compartment 112 to an upper surface of main compartment 112. In embodiments, the disposable liners 120 may be configured to assist in maintaining grocery bag 100 in an upright position by providing additional support for the inner sidewall of main compartment 112 of reusable grocery bag 110.

Figure 2:
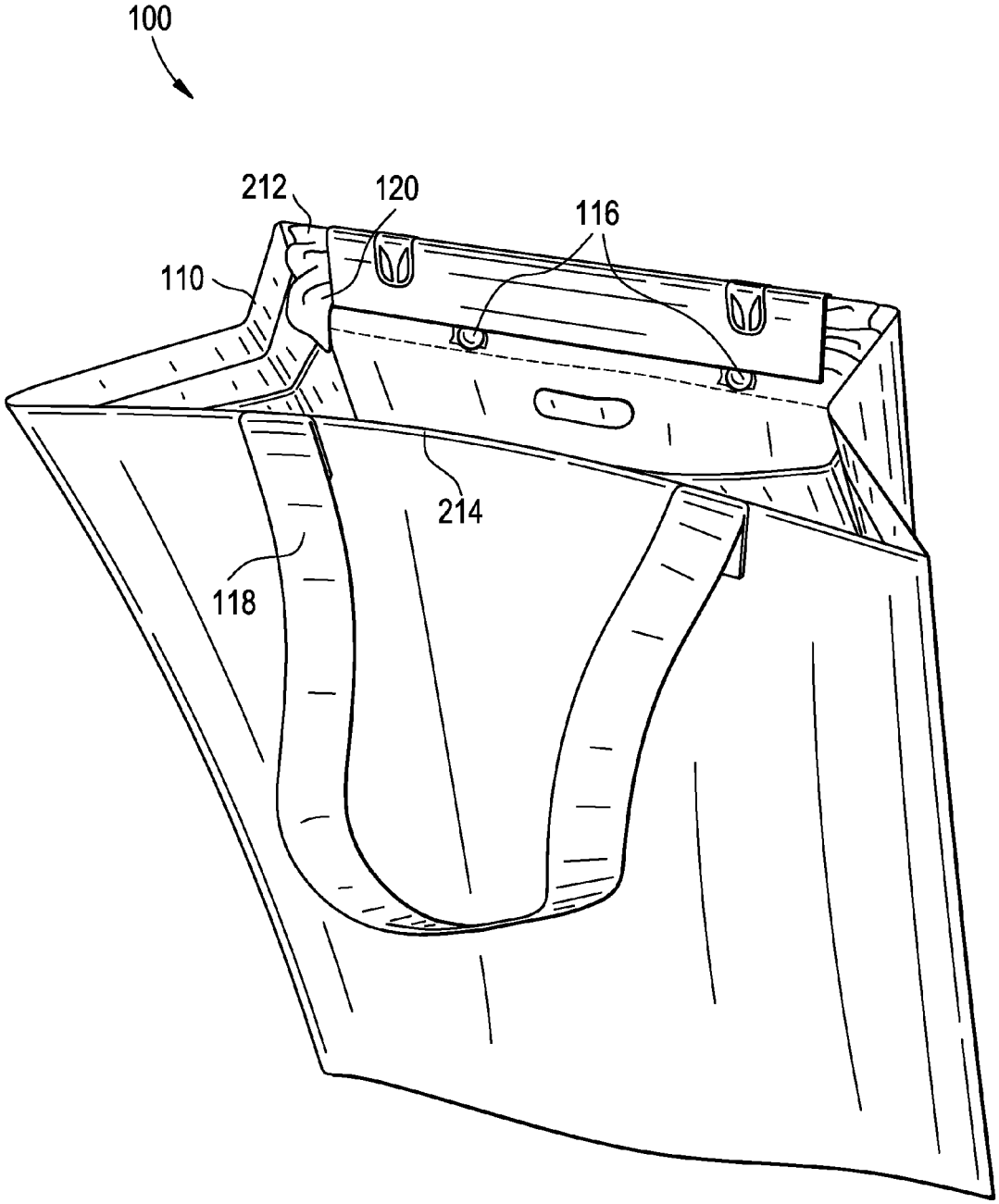
FIG. 2 depicts one embodiment of disposable liners coupled to a reusable grocery bag.

FIG. 2 depicts one embodiment of a grocery bag 200. Grocery bag 200 may include a reusable grocery bag 210, a set of disposable liners 220, and coupling members 116.

Disposable liners 220 may be configured to be positioned flush against a surface 230 of first side 212 of reusable grocery bag 210.

First coupling members 116 may be positioned on an inner surface of reusable grocery bag 110. First coupling members 116 may be a first adhesive surface (e.g. glue), snaps, a hoop and lock mechanism such as Velcro, a zipper, hook(s), pin(s), button(s), clip(s), rod(s), etc. In one embodiment, first coupling members 116 may be positioned on an upper portion of an inner sidewall of grocery bag 110, and be configured to receive second coupling members 126 disposed on the set of disposable liners 120. One skilled in the art will appreciate that either first coupling members 116 may be the female or male components configured to receive a corresponding second coupling members 116 disposed on disposable liners 120.

Second coupling members 116 may be positioned on outer surface of the set of disposable liners 120. Second coupling members 116 may be snaps, a hoop and lock mechanism such as Velcro, a zipper, hook(s), pin(s), button(s), clip(s), rod(s), etc. In one embodiment, second coupling members 116 may be configured to receive first coupling members 116 disposed on an inner surface of main compartment 112. In embodiments, coupling members 116 may be utilized such that a new set of disposable liners 120 may be coupling to sidewall 212 of reusable bag 110. Therefore, once a first set of disposable liners 120 is used, a second set of disposable liners 120 may be coupled to sidewall 212. One skilled in the art will appreciate that coupling members 116 may be positioned on a first sidewall 212 or second sidewall 214 of reusable grocery bag 110.

Figure 3:
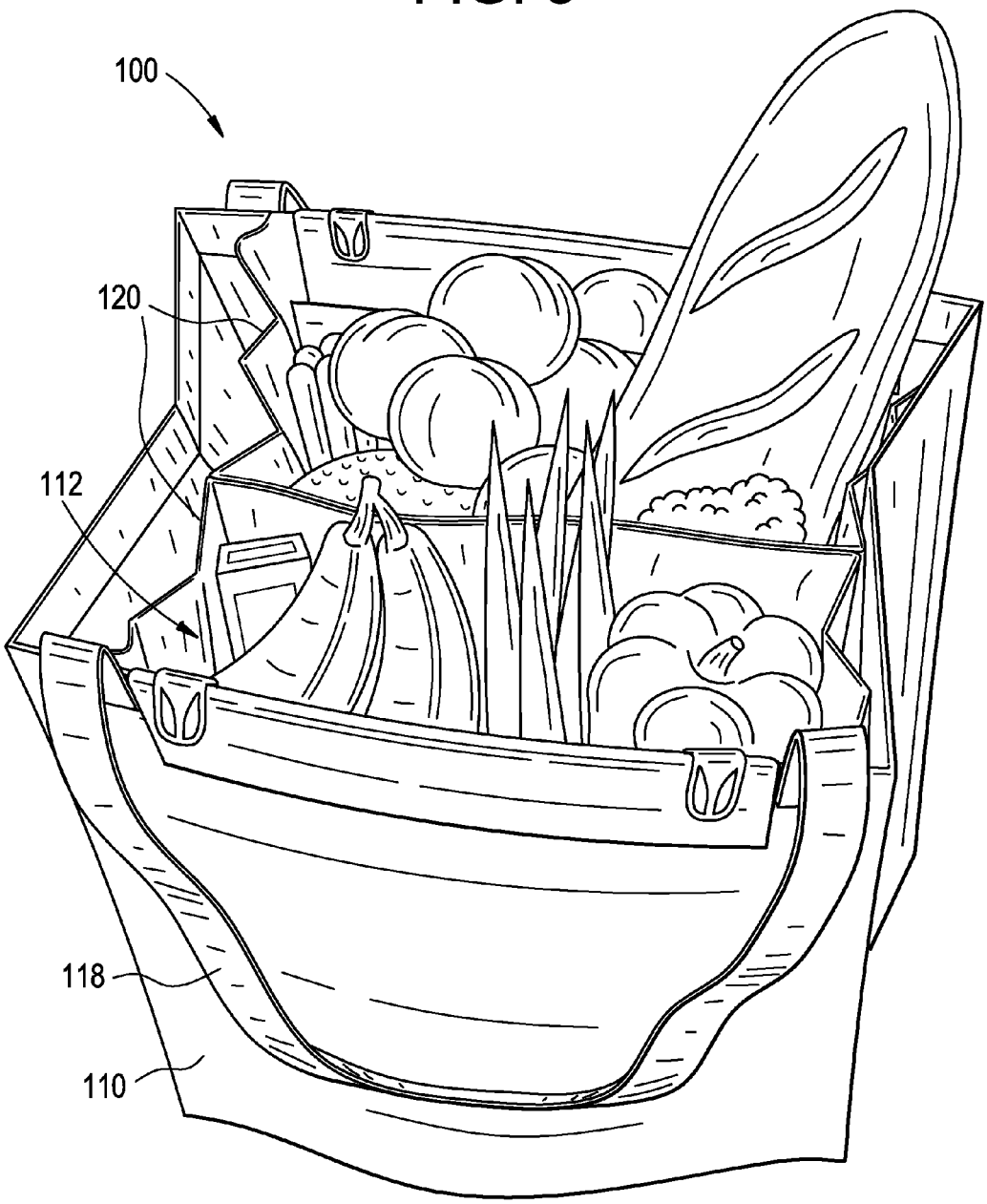
FIG. 3 depicts one embodiment of a plurality of disposable liners within a reusable grocery bag.

FIG. 3 depicts one embodiment of a reusable grocery bag 110 being used with two disposable liners 120(*a*) and 120(*b*). In embodiments, a first disposable liner 120(*a*) may be positioned proximate first side wall 212 of reusable grocery bag 110, a second disposable liner 120(*b*) may be positioned proximate second side wall 214 of reusable grocery bag 110, and a surface of first disposable liner 120(*a*) may be positioned adjacent to a surface of second disposable liner 120(*b*). In embodiments when multiple disposable liners 120(*a*) and 120(*b*) are in use, both disposable liners 120(*a*) and 120(*b*) may extend from an upper surface of reusable grocery bag 110 to a lower surface of reusable grocery bag 110 to maximize the space within the disposable liners 120(*a*) and 120(*b*).

In further embodiments, more than two disposable liners 120 may be used to line an inner surface of reusable grocery bag 110. Therefore, as a user is shopping for items of various types (e.g. milk, produce, meat, etc.), the user may dynamically use an extra disposable liner 120 to place the items of varying types, such that the items of varying types do not touch. By dynamically using disposable liners 120, the user may create any desired number of sub compartments within reusable grocery bag.

Figure 4:
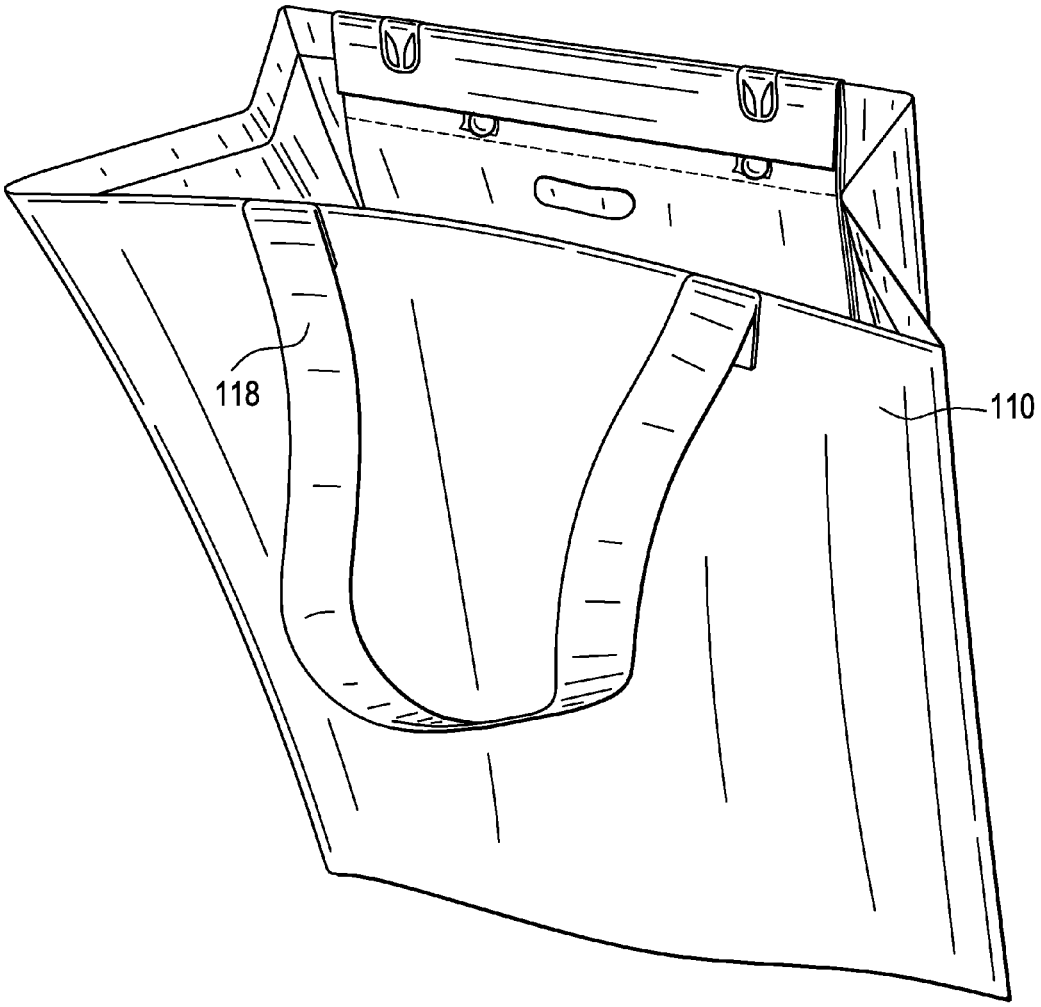
FIG. 4 depicts one embodiment of a reusable grocery bag.

FIG. 4 depicts one embodiment of reusable grocery bag 110. Reusable grocery bag 110 may be comprise of various shapes and/or sizes, and include handles 118. Handles 118 may be used in assisting a user to transport reusable grocery bag 110.

Figure 5:
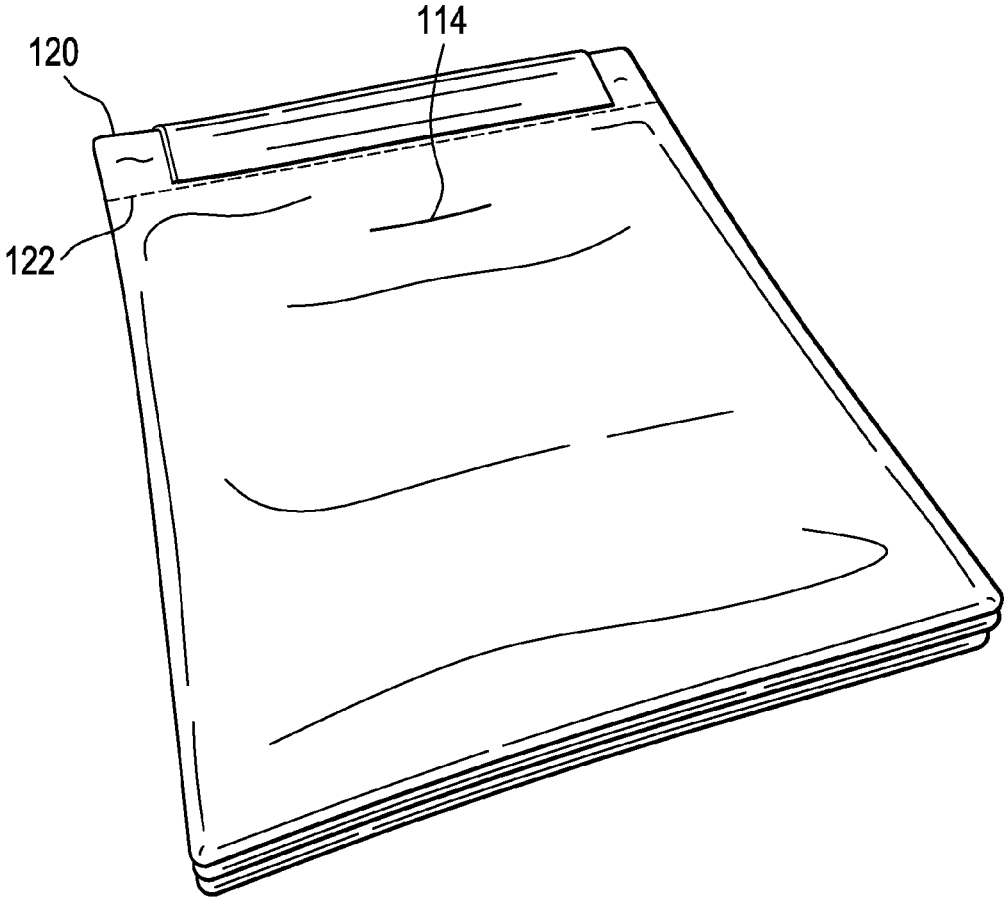
FIG. 5 depicts one embodiment of a set of disposable liners.

FIG. 5 depicts one embodiment of a set of disposable liners 120. As depicted in FIG. 5, each of the disposable liners with a set of disposable liners 120 may have an orifice 114 that extends through the set of disposable liners 120 to form a handle, wherein orifices 114 may be aligned to form a unified handle through the set of disposable liners 120.

As also depicted in FIG. 5, separator member 122 may extended across a surface of disposable liners 120, wherein the separator member 122 is positioned below a coupling member that couples disposable liners 120 to reusable grocery bag 110. Therefore, a disposable liner may be decoupled from the set of disposable liners 120, while the set of disposable liners 120 remains coupled to reusable grocery bag 110.

In the foregoing specification, embodiments have been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A system comprising:

a reusable grocery bag including an inner surface, open top surface, and first coupling members, the reusable grocery bag being configured to be transported from a first location to a second location; and a first set of disposable liners being coupled to a first sidewall of the inner surface of the reusable grocery bag in a first orientation and being configured to cover the inner surface of the reusable grocery bag in a second orientation, wherein the first set of disposable liners extends from an upper surface of the reusable bag towards a lower surface of the reusable grocery bag in the first orientation and the second orientation;

a second set of disposable liners being coupled to a second sidewall of the inner surface of the reusable grocery bag, wherein the second set of disposable liners extends from an upper surface of the reusable bag towards a lower surface of the reusable grocery bag in the first orientation and the second orientation, wherein in the second orientation a first disposable liner of the first set of disposable liners is configured to be opened within the reusable grocery bag to cover a first portion of the reusable grocery bag without decoupling the first disposable liner of the first set of disposable liners from the first set of the disposable liners, and a first disposable liner of the second set of disposable liners is configured to be opened within the reusable grocery bag to cover a second portion of the reusable grocery bag without decoupling the second disposable liner of the second set of disposable liners from the second set of disposable liners, wherein the first disposable liner of the first set of disposable liners and the first disposable liner of the disposable liners are configured to be used simultaneously; and second coupling members disposed on the first set of disposable liners and the second set of disposable liners, the second coupling members being configured to interface with the first coupling members.

2. The system of claim 1, wherein the first set of disposable liners is comprised of biodegradable materials.

3. The system of claim 1, wherein the reusable grocery bag is comprised of a pliant and a resilient material, wherein the reusable grocery bag is configured to be washable.

4. The system of claim 1, further comprising:

first orifices disposed on the first sidewall and a second sidewall of the reusable grocery bag;

second orifices disposed on the first set of disposable liners, wherein the first orifices and the second orifices are configured to align with each other to form a unified handle extending through the reusable grocery bag and the first set of disposable liners.

5. The system of claim 1, wherein a disposable liner is configured to be separated from the first set of disposable liners.

6. The system of claim 5, wherein the disposable liner is configured to cover the inner surface of the reusable grocery bag.

7. The system of claim 5, wherein the disposable liner is configured to extend around a circumference of an outer surface of the reusable grocery bag, and to the lower surface of the reusable grocery bag.

8. The system of claim 5, wherein the disposable liner is configured to be separated from the first set of disposable liners after items are disposed within the disposable liner.

9. The system of claim 1, wherein a plurality of disposable liners from the first set of disposable liners are configured to simultaneously cover the inner surface of the reusable grocery bag.

* * * * *